US008834334B2

(12) United States Patent
Palm et al.

(10) Patent No.: US 8,834,334 B2
(45) Date of Patent: Sep. 16, 2014

(54) METHOD OF CONTROLLING THE RELATIVE POSITION BETWEEN PRINTED PATTERNS AND NON-PRINTED PATTERNS ON A WEB-SHAPED MATERIAL AND A SYSTEM USED IN THE METHOD

(75) Inventors: Lars Palm, Åkarp (SE); Fredrik Lindgren, Lund (SE); Klaus Hamacher, Melle (DE); Markus Clermont, Halle (DE)

(73) Assignee: Tetra Laval Holdings & Finance S.A., Pully (CH)

( * ) Notice: Subject to any disclaimer, the term of this patent is extended or adjusted under 35 U.S.C. 154(b) by 718 days.

(21) Appl. No.: 13/139,532

(22) PCT Filed: Dec. 17, 2009

(86) PCT No.: PCT/SE2009/000521

§ 371 (c)(1),
(2), (4) Date: Jul. 6, 2011

(87) PCT Pub. No.: WO2010/071543

PCT Pub. Date: Jun. 24, 2010

(65) Prior Publication Data

US 2011/0256996 A1 Oct. 20, 2011

(30) Foreign Application Priority Data

Dec. 18, 2008 (SE) ..... 0802602

(51) Int. Cl.

| | |
|---|---|
| ***B31B 49/00*** | (2006.01) |
| ***B65H 23/188*** | (2006.01) |
| ***B41F 33/00*** | (2006.01) |
| ***B41F 19/00*** | (2006.01) |
| *B41M 1/24* | (2006.01) |

(52) U.S. Cl.

CPC ..... *B65H 23/1882* (2013.01); *B65H 2553/42* (2013.01); *B65H 2301/5126* (2013.01); *B65H 2801/21* (2013.01); *B41M 1/24* (2013.01); *B65H 2557/264* (2013.01); *B65H 2301/5152* (2013.01); *B41F 33/0081* (2013.01); *B41F 19/00* (2013.01)

USPC ..... 493/8; 493/11; 493/19; 493/22; 493/34

(58) Field of Classification Search

CPC ..... B41F 19/00; B41F 33/0081; B65H 2301/5152; B65H 2553/42; B65H 3557/264; B65H 2301/5216; B65H 23/1882; B65H 2801/21; B41M 1/24

USPC ..... 493/8, 11, 13, 14, 15, 17, 18, 19, 22, 493/24, 29, 34

See application file for complete search history.

(56) References Cited

U.S. PATENT DOCUMENTS 3,276,183 A * 10/1966 Carlisle, Jr et al. ..... 53/51
4,781,090 A * 11/1988 Feldkamper et al. ..... 83/74

(Continued)

FOREIGN PATENT DOCUMENTS

GB 1 521 993 A 8/1978
GB 1521993 A 8/1978

(Continued)

OTHER PUBLICATIONS

Japanese Office Action dated Dec. 9, 2013, issued in corresponding Japanese Patent Application No. 2011-542052 and an English Translation of the Japanese Office Action. (11 pgs).

(Continued)

*Primary Examiner* — Hemant M Desai

(74) *Attorney, Agent, or Firm* — Buchanan Ingersoll & Rooney PC

(57) ABSTRACT

A method and a system for controlling the relative position between a printed pattern and a non-printed pattern, such as for example a pattern of creasing lines or holes, on a running web-shaped material, involves providing the material web with at least one impressed indentation mark with a three-dimensional topographic configuration, at a pre-determined distance from a printed register mark and detecting the marks with a same sensor control system. The controlling method and system is used for the manufacturing of a laminated packaging material, having a printed décor and creased folding lines in register.

29 Claims, 7 Drawing Sheets

(56) References Cited

U.S. PATENT DOCUMENTS

| | | | | | |
|---|---|---|---|---|---|
| 5,001,325 | A | * | 3/1991 | Huizinga | 219/121.69 |
| 5,058,175 | A | * | 10/1991 | Aso | 382/112 |
| 5,766,389 | A | | 6/1998 | Brandon et al. | |
| 5,767,975 | A | | 6/1998 | Åhlen | |
| 8,099,933 | B2 | * | 1/2012 | Benedetti et al. | 53/451 |

FOREIGN PATENT DOCUMENTS

| | | | |
|---|---|---|---|
| JP | 63-295290 | A | 12/1988 |
| JP | S63295290 | A | 12/1988 |
| JP | H047154 | A | 1/1992 |
| JP | H07178892 | A | 7/1995 |
| JP | H1128805 | A | 2/1999 |
| JP | 2002137368 | A | 5/2002 |
| JP | 2003048310 | A | 2/2003 |
| JP | 2008238504 | A | 10/2008 |
| SE | 5626054 | C2 | 6/2005 |
| SE | 527 359 | C2 | 2/2006 |
| SE | 527359 | C2 | 2/2006 |
| WO | WO 2004/030911 | A1 | 4/2004 |
| WO | WO 2005/049326 | A1 | 6/2005 |

OTHER PUBLICATIONS

International Search Report (PCT/ISA/210) issued on Apr. 9, 2010, by Swedish Patent Office as the International Searching Authority for International Application No. PCT/SE2009/000521.

* cited by examiner

METHOD OF CONTROLLING THE RELATIVE POSITION BETWEEN PRINTED PATTERNS AND NON-PRINTED PATTERNS ON A WEB-SHAPED MATERIAL AND A SYSTEM USED IN THE METHOD

This patent application is a U.S. National Phase of International Patent Application No. PCT/EE2009/000521, filed 17 Dec. 2009, which claims priority to Swedish Patent Application No. 0802603-3, filed 18 Dec. 2008, the disclosures of which are incorporated herein by reference in their entirety.

TECHNICAL FIELD

The present invention concerns a method of controlling the relative position between a printed pattern and a non-printed, three-dimensional, pattern, such as for example a pattern of creasing lines or holes, on a running, i.e. moving, web-shaped material, as well as a system for use in the method. According to a further aspect of the invention said controlling method is used for the manufacturing of a laminated packaging material, having a printed décor and creased folding lines in register.

PRIOR ART

In the art of manufacturing of a sheet material or a laminated packaging material in the form of a running material web, there is often printed a décor pattern or a colour pattern onto the material on the side intended for the exterior of the package. In addition, the material is often provided with a repetitive pattern or a recurring feature such as for example holes, cuts, perforations or folding lines, in order to facilitate the reformation of the sheet or material into finished articles or packages.

Specifically, in the art of manufacturing of liquid carton packaging containers, a material web is provided with folding lines, so called creases or creasing lines, and possibly also with holes intended for the attachment of opening devices. In addition to the creasing lines, the packaging material is provided with a printed décor, whereby a creasing tool, such as normally a pair of creasing rollers, is coordinated with a printing press. The packaging material is then cut and the cut web or blanks is folded along the creasing lines and re-formed into final packaging containers. In order to provide the final packaging containers with the desired function, appearance and shape, with the printed pattern in the right position on the package, it is important that the print, creasing lines and possible cut holes or perforations are correctly positioned relative to each other on the material web. In the subsequent re-formation into packaging containers, it is also important that the printed pattern, the creasing pattern and the holes are correctly placed with respect to each other in order not to disturb the function of the filling machine. Adjustment of the relative position of the print to the creased pattern is presently carried out manually, when the printing press is started up to be running. During running of the manufacturing process, there is normally no automatic control of whether the print and creases are correctly aligned relative to each other. When manually adjusting and correcting, alignment is achieved with accuracy in the order normally of about ±0.25 mm.

The creasing lines are extending in the machine direction (MD) of the material web or across the material web in the transversal direction (TD), perpendicularly or diagonally, and the position of the holes may be anywhere between the creasing lines.

Holes intended for opening devices, may be made in the material web in different ways. Traditionally, the holes are mechanically punched in the same operation, or in a similar operation to the operation in which the material is provided with creasing lines. According to a newer technology, the holes are cut in a subsequent operation to the creasing operation, downstream the converting of the material web, which converting results in a laminated packaging material.

SUMMARY OF THE INVENTION

One object of the present invention is to facilitate the continuous monitoring of the register, i.e. the relative position between a printed pattern and a non-printed, three-dimensional structure or pattern, such as creased lines and/or holes or perforations, and the control and correction thereof, when needed.

Another object of the present invention is to continuously monitor and control the register between a printed pattern and a non-printed, three-dimensional structure or pattern, such as creased lines and/or holes or perforations, with improved accuracy.

A further object is to continuously monitor and control the register between a printed pattern and a non-printed, three-dimensional structure or pattern, such as creased lines and/or holes or perforations, in a cost-efficient operation at improved accuracy and with no time loss or delay between measurements.

These objects are attained by a method of controlling the register, between a printed pattern and a non-printed pattern, with high accuracy, on a running material web, comprising the steps of a) printing at least one printed pattern and at least one, printed, two-dimensional, register mark on the web,
b) creating a non-printed pattern or recurring feature on the web,
c) simultaneously, and in synchronisation with the operation of carrying out step b), impressing an indentation having a three-dimensional topographic configuration, such that a shadow is created from the indentation when illuminated, on the web at a pre-determined distance from the printed register mark, the indentation thereby producing a dark spot when illuminated,
d) determining the position of the said shadow or dark spot relative to the position of the printed mark, by illuminating and detecting with an optical sensor system, the shadow, caused by the indentation configuration, the shadow being detectable by the same optical sensor system as used for detecting the printed mark,
e) comparing the value of the measured position of the shadow created from the impressed indentation relative to the position of the printed mark with a pre-set value, and
f) regulating the operation of creating said non-printed pattern or recurring feature as well as of said synchronised, impressed indentation and/or regulating the printing operation, in order to adjust the measured value to the pre-set value.

The distinct shadow or dark spot, which is created when illuminating the impressed indentation mark, arises because the indentation has a three-dimensional topographic configuration that gives poor reflection of incident light, in an isotropically illuminated area. The shadow is detected at its centre of gravity, i.e. at the darkest point of the shadow, from which the lowest amount of light is reflected back when the indentation is illuminated.

Preferably, the printing operation is carried out before the non-printing operation, but may also be carried out after the non-printing operation(s).

According to one preferred embodiment of the invention, step a) is carried out before step b) and concerns providing a pre-printed material web having at least one printed pattern and at least one printed, two-dimensional, register mark on the web.

According to an alternative embodiment of the invention, step b) is carried out before step a) and concerns providing a pre-made material web, having at least one non-printed pattern or recurring feature and at least one, impressed indentation mark having a three-dimensional topographic configuration, such that a shadow is created from the indentation when illuminated, on the web at a pre-determined distance from the printed register mark, the indentation thereby producing a dark spot when illuminated.

For best possible alignment of the register between the printed and the non-printed patterns, the position of the said shadow relative to the position of the printed mark is determined both in the machine direction (MD) and in the transversal direction (TD).

Commonly and preferably, the printed pattern comprises several consecutively printed colours, each printed colour pattern having a printed register mark and each respective consecutive printed mark being controlled to be in register with the first printed mark in a print-to-print controlling operation, by means of an optical sensor system.

It is preferable that the size and the shape of the top view contour of the said impressed indentation and shadow is given approximately the same size and shape as of the printed mark, and more preferably, the top view contour of the said shadow, as well as the printed mark, are given the shape of a circular dot.

According to one preferred embodiment of the invention, the non-printed pattern is a pattern of creased or scored folding lines.

According to other preferred embodiments, the non-printed pattern comprises repetitive partly punched or cut perforation lines or punched or cut holes.

Alternatively, the non-printed pattern may be an embossed pattern or relief pattern.

In order to continuously monitor and control the alignment of the two operations, it is preferred that step f) of regulating the operation of creating the non-printed pattern and/or the printing operation comprises regulating the web position in the transversal direction, for example by controlling a side guiding system.

It is also preferred that the step f) of regulating the operation of creating the non-printed pattern and/or the printing operation comprises instantaneously regulating the rotational speed of one or more of the printing rollers and/or the feeding rollers of the operation wherein the non-printed pattern is created. Specifically, the step f) of regulating the operation of creating the non-printed pattern and/or the printing operation comprises instantaneously regulating the rotational speed of one or more of the printing rollers and/or the creasing rollers. For the keeping of the register between the printed pattern and the non-printed pattern, normally the same travelling speed should be held by the web throughout the material web manufacturing line. However, when the register needs to be corrected, the speed of one or more rollers or operations may be merely instantaneously corrected in order to align the web position and achieve aligned register again.

Preferably, the impressed indentation is formed by pressing a pointed tip into the material web at a pre-determined depth. Preferably, the impressed indentation has an opening contour with a width W at the surface of the web material and a maximum depth d at a bottom point within the area of the opening contour, such that the surfaces of the indentation are inclining towards each other at the bottom point at an acute angle. Also preferably, the impressed indentation has an opening contour with a width W at the surface of the web material and a maximum depth d at a bottom point within the area of the opening contour, whereby the ratio between the opening width W and the maximum depth d is less than 2.

According to a preferred embodiment, the impressed indentation has the shape of an inverse, hollow cone with a circular or elliptical, open, base. Alternatively, the impressed indentation may have the shape of an inverse, hollow tip or pyramid with a base of triangular, square, rectangular or rhomboid shape, i.e. shape of the opening contour.

Thus, especially, the same detection equipment is used for determining the position of both the print and the creased pattern. This may be done continuously during the manufacturing process, which provides improved accuracy of the measurements.

The printed register marks are indicating the position of the respective printed colour. In the measurement of the relative position of a printed mark, it is illuminated by a light source, for example by diffused light, in order to enable detecting with a camera or optical sensor the printed register marks. The position of the creased pattern or the recurring feature, such as holes or perforations, and the impressed indentation mark, may be simultaneously determined by including also the impressed indentation mark in the camera view or optical sensor detection area.

If the measured values of the relative positions, i.e. the distance between, and the lateral alignment of, the printed marks and the impressed mark are not coinciding with the pre-set value, there will be an internal regulation of the creasing tool and/or the printing press.

According to another aspect of the invention, a method of manufacturing a packaging material inducing less waste material and having improved accuracy of the print to non-print, especially print-to-crease register, using said controlling method as described above and in claim 1, is provided.

According to a further aspect of the present invention, the measured position determined for a printed register mark, may be used also for controlling an arrangement for the cutting of holes or perforations or similar, in a subsequent operation downstream the converting line of the material web. According to this aspect, holes or perforations are cut by laser, according to known technology, instead of being mechanically punched or formed in connection with the creasing operation. By means of such a cutting arrangement, a pattern of repetitive opening holes or perforation openings are created in the moving material web, which openings are to be part of an opening device in the final packaging container.

In this manner, according to the invention, the detection of a printed register mark may be used both for controlling the position of the creasing lines and for controlling a tool which is somehow carrying out an operation on the material web, with improved over-all accuracy because the accuracy of the relative positions of print-to-crease is greatly improved. Thus, from the determined position of the printed pattern, the creases are correctly positioned, as well as eventual openings holes or perforations.

According to a still further aspect of the present invention, a system used in a method of manufacturing a material web having a printed pattern in register with a non-printed pattern or recurring feature on the material web, as defined in claim 20 is provided. Preferred embodiments of the system according to the invention are defined in pending claims 21-29.

Accordingly, the invention involves a system having g) a station for providing a printed material web, wherein at least one pattern is printed together with at least one, printed, two-dimensional register mark on the web, h) a station for creating a non-printed pattern or recurring feature on the web, and, impressing means for simultaneously, and in synchronisation with the creation of the non-printed pattern or feature, creating an indentation having a three-dimensional topographic configuration, such that a shadow is created from the indentation when illuminated, on the web at a pre-determined distance from the printed register mark, i) an optical sensor system for determining the position of the said shadow relative to the position of the printed mark by detecting the shadow produced by said three-dimensional indented configuration when illuminated, and by detecting the printed mark, j) a comparation means for comparing the value of the measured position of the shadow relative to the position of the printed mark with a pre-set value, and k) controlling means for regulating the operation of creating said non-printed pattern or recurring feature as well as said synchronised, impressed indentation and/or for regulating the printing operation, in order to adjust the measured value to the pre-set value.

According to one embodiment of the invention, the station g) precedes the station h) and further comprises an unwinding station, the printed pattern and the printed register mark having been pre-printed onto the web in a separate preceding operation.

According to an alternative embodiment of the invention, the station h) precedes the station g). According to a further alternative, the station h) precedes the station g) and comprises an unwinding station, the non-printed pattern or recurring feature together with the impressed indentation mark having been pre-created onto the web in a separate operation.

Preferably, the print station is placed before the station for applying the non-printed pattern and the optical sensor system is placed after said station for applying the non-printed pattern.

According to a preferred embodiment of the invention, the station for creating a non-printed pattern or recurring feature on the web comprises a creasing station.

Alternatively, or in addition to the creasing station, the station for creating a non-printed pattern or recurring feature on the web may comprise a perforation or hole punching station.

Alternatively, or in addition to the creasing station, the station for creating a non-printed pattern or recurring feature on the web may comprise a perforation or hole cutting station.

Alternatively, the station for creating a non-printed pattern or recurring feature on the web is an embossing station.

Preferably, the optical sensor system comprises a sensor control system of the type having a matrix camera, such as for example a CCD-camera, integrated with an illumination source and adapted to detect and visualise pre-defined register marks.

It is preferred that said comparation means includes a computer, which is connected to the optical sensor for registration of the measured relative positions and to the controlling means for regulating the operation of the printing press and/or the non-printing operation.

According to one preferred embodiment of the invention, said controlling means for regulating the operation of creating the non-printed pattern and/or the printing operation comprises regulating means for moving the web position in the transversal direction.

According to another preferred embodiment of the invention, said controlling means for regulating the operation of creating the non-printed pattern and/or the printing operation comprises regulating means for instantaneously adjusting the rotational speed of one or more of the printing rollers and/or the feeding rollers of the operation wherein the non-printed pattern is created.

According to a further preferred embodiment of the invention, said controlling means for regulating the operation of creating the non-printed pattern and/or the printing operation comprises regulating means for instantaneously adjusting the rotational speed of one or more of the printing rollers and/or the creasing rollers.

Preferably, the means for impressing said indentation comprises a pointed tip, to be pressed into the material web at a pre-determined depth.

In order to analyse the pictures taken by the camera, identify the type of packaging container to be produced and to make the necessary adjustments of the creasing tool and/or the printing press, a computer is used. The computer is programmed with the size and shape of the marks, the pre-set values of the distances to be measured for each intended type of packaging container, the type of packaging container normally being identified by the printed register mark and the positions of the creasing lines.

Further objects and advantages of the method of the present invention will be obvious to a person skilled in the art reading the detailed description below of at present preferred embodiments.

BRIEF DESCRIPTION OF THE DRAWINGS

The invention will be described further below by way of example and with reference to the enclosed drawings. In the drawings.

DETAILED DESCRIPTION OF PREFERRED EMBODIMENTS

Figure 1A:
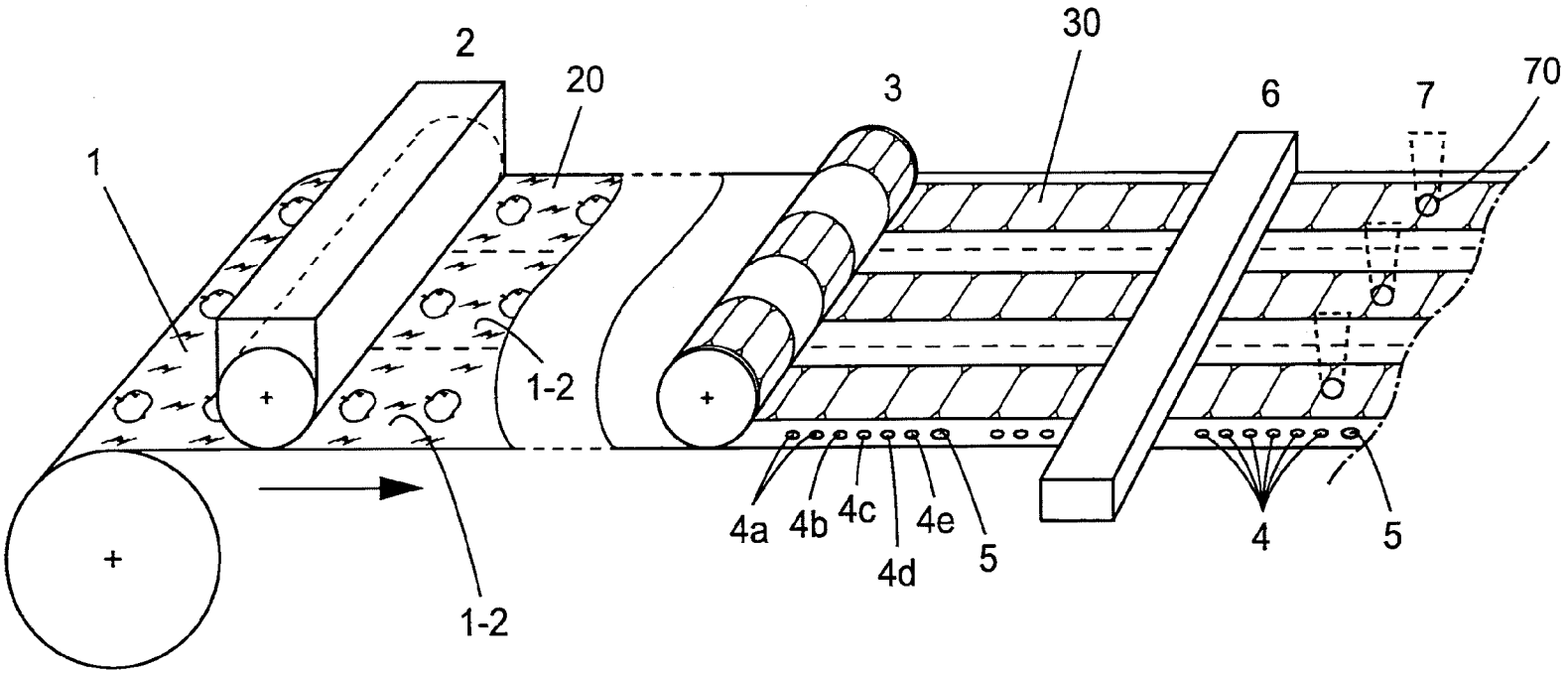
FIG. 1*a* is a principal view of a manufacturing line for the converting of a web-shaped packaging material.

FIG. 1*a* thus shows a manufacturing line for the converting of a web-shaped packaging material. Before a material web 1 from which packaging containers are to be formed, such as for example for the packaging of food products, is coming to a detection position according to the present invention, it has passed a printing press 2, with a number of printing units (only one shown in the Figure), and a station for creating a non-printed pattern 30, such as for example a creasing tool 3. In the creasing tool 3, creases or creasing lines are formed on the web material, in the MD and/or in the TD. Packaging containers are to be folded along these creasing lines, which form a three-dimensional structure in the surface of the material web. In the printing press 2, text and/or pictures are printed onto the material web 1. The print 20 may vary depending on the appearance of the final package. The printed pattern 20 includes also printed register marks 4, which may help to control the position of the print. One or more printed register marks 4 may be made in different ways for identifying different packages and a pre-set value on the distance to creasing lines. The register mark is preferably formed with areas that are rich in contrast and as a two-dimensional structure. Normally, the appearances of different register marks are stored in a computer, and are used in the identification of different packages.

Normally, a printed décor comprises several printed patterns, each in one single colour, which when printed on top of each other, together forms a full printed décor. In order to obtain a clear and good-looking print with sharp focus of text and pictures, it is necessary to align the respective printed patterns to each other. This has hitherto been done by detecting the relative positions of printed marks from each respective pattern with respect to each other, after each printing unit, which marks have the same size and shape but different colours, by one and the same optical sensor or camera.

The accuracy in such print-to-print alignment is quite high and the printing operation may be controlled such that the alignment is continuously monitored and regulated by known and existing optical sensor equipment.

The material web 1 often comprises a number of parallel lanes or part-webs (1-1, 1-2 etc), which can be intended for packages for the same or for different types of products to be packed, i.e. having the same or different printed décor. It is normally sufficient to mark and control the position of the marks along one lane on the full web width.

The printing station 2 and the non-printing/creasing station 3 may be positioned in any order along the material web manufacturing line. The long direction of the material web is shown with an arrow in FIG. 1.

In the creasing operation, an impressed indentation mark 5 having a three-dimensional configuration is made simultaneously with the creasing lines, preferably by pressing a pointed tip positioned on the creasing roller into the material at a pre-determined distance from the printed registration mark(s) 4.

Downstream the material web, after the two printing 2 and non-printing stations 3, an optical sensor arrangement 6 is positioned, for the simultaneous detection and determination of the positions of all register marks 4 and 5.

A computer, not shown, is connected to the optical sensor or camera 6, and also to a controlling means for regulating the operation of the creasing tool 3 and the printing press 2. Furthermore, the computer has stored updated information on the different types of packaging containers, which information is presented when the material web 1 has been identified. The computer is carrying out the analysis of the pictures taken by the camera(s) or optical sensor(s) and registers the detected relative positions of the respective register marks and makes calculations based on the said analysis. Since the different parts of the computer are not unique by themselves, they will not be further presented here.

The printed register mark 4, can be detected and registered if it has been printed on a surface which has a lighter shade than the register mark, as long as there is sufficient contrast between the register mark 4 and the printed surface. In practice, the register marks 4 and 5 can be detected as long as they are not created onto a dark surface.

Normally, and preferably, a paperboard-based packaging material is coated after the printing and creasing operations, with outer layers of plastics in order to protect against moisture and liquid. The laminated packaging material is often also provided with an oxygen barrier layer of for example aluminium foil, on one side of the paperboard, between the paperboard and the outer plastics layer.

Alternatively, the material web may be coated with a thin plastics layer, after the printing operation but before the creasing. It is, thus, also possible within the scope of the invention to create an impressed indentation mark on a plastics-coated paper web.

On some packaging types, opening holes or perforations are made in a subsequent operation 7 downstream the converting line of the material web. Preferably, this is made by laser cutting according to known technologies. The opening holes and perforations 70 may be intended for specific opening devices, for straws, for facilitating the opening of the package, etc. It is important that such openings and perforations are adjusted to the positions of the printed and the non-printed pattern.

According to a further aspect of the invention, the position and the registration of the printed register mark 4, may, thus, be used for controlling a unit placed downstream in the converting line, for example a laser cutting arrangement, in order to cut out a repetitive pattern, for example holes or perforations in the material web.

Figure 1B:
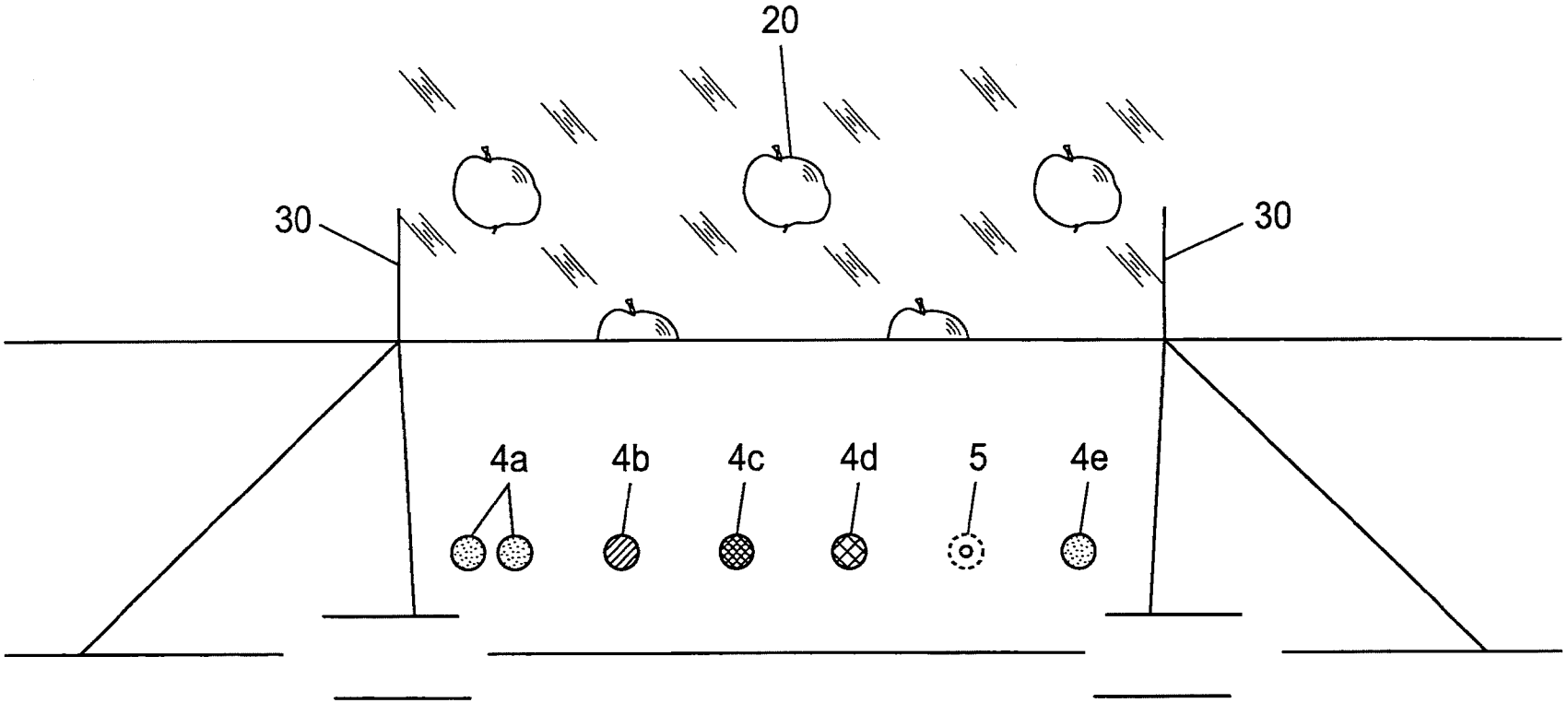
FIG. 1*b* is showing with a top view a piece of a web-shaped packaging material with a printed pattern in alignment with a pattern of creasing lines for subsequent fold-forming of the packaging material into packages, as well as the register marks for each respective pattern.

FIG. 1*b* shows with a top view a piece of a web-shaped packaging material 1 with a printed pattern 20 in alignment with a pattern of creasing lines 30 for subsequent fold-forming of the packaging material into packages, and the register marks 4 and 5 for each respective pattern. The piece shown in the example represents the bottom part of a package. The creasing lines are created in a pattern 30 of lines along the web in the machine direction MD and across the web, in the transversal direction (TD) of the web. The printed pattern 20 may comprise pictures, text and/or merely coloured areas. Optionally, the packaging material is provided with punched or cut holes or perforations in the material web at pre-determined positions aligned with the printed pattern.

Figure 2:
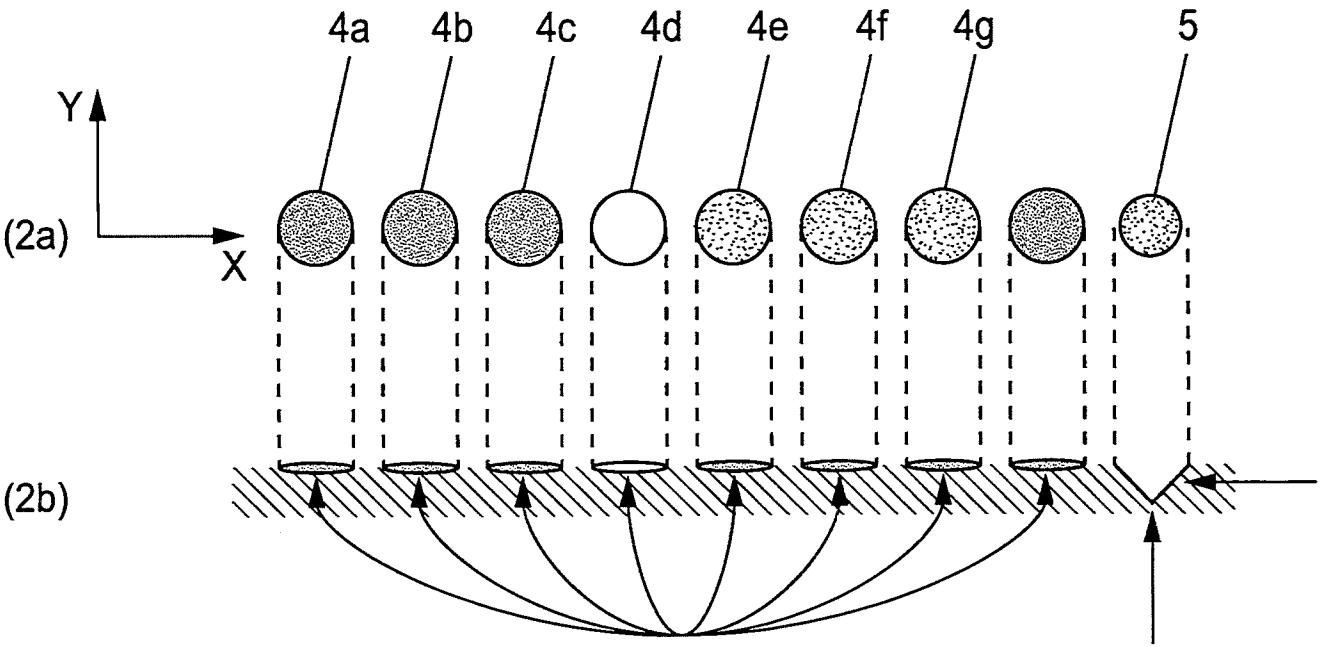
FIG. 2 is showing with a top view 2*a*, as viewed by the camera/optical sensor, and a corresponding side view 2*b* the principle of position detection of the various register marks.

In FIG. 2, a row of printed detection marks 4*a*, 4*b*, 4*c*, 4*d*, 4*e*, 4*f*, 4*g*, 4*h* and 5 are shown with a view 2*a* from above, as viewed by the optical sensor or camera 6. Thus, one printed register mark 4 is printed along with each respective printed colour pattern. An impressed indentation mark 5 is created, in synchronisation with the subsequent operation, specifically a creasing operation, whereby a shadowed or dark spot is produced by being illuminated, at a pre-determined distance from the printed register marks. The relative position of the impressed mark 5 is determined in relation to the printed marks 4 by sensing optically by a camera, the position of each coloured or dark and shadowed mark, respectively, in contrast to the light background on the material web. From a corresponding side view 2*b*, it can be seen that the printed register marks 4 all have a configuration in two dimensions only, on the surface of the web, while the impressed mark has a three-dimensional indented configuration, into the web Material. It is important that the impressed mark 5 is positioned in rather close vicinity of the printed register marks, such that the relative positions of the marks 4 and 5 may be determined and aligned by one and the same optical sensor or camera equipment. By such an arrangement, a higher accuracy of the measurement of the distance between the marks will be achieved, along with a more simple equipment set-up in the material manufacturing line. Compared to the existing technology with manual adjustment of the printing and/or creasing operations for the alignment of print-to-crease, which provides a measurement accuracy in the order of ±0.05 mm and a controlling accuracy in the order of about ±0.25 mm, the measurement accuracy may be increased to the order of ±0.01 mm while the controlling accuracy may be increased to the order of about ±0.1 mm, by using the method according to the invention.

Figure 4A:
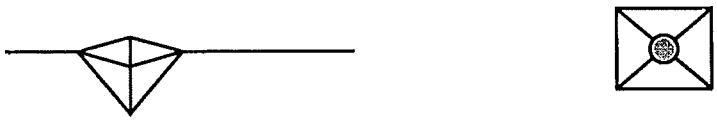
FIG. 4*a* shows a side view (left) of a still further example of a specific configuration of the impressed mark and a top view (right) of the same mark.
Figure 4B:
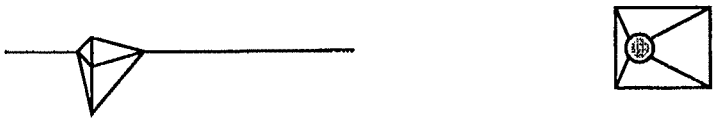
FIG. 4*b* shows a side view (left) of a still further example of a specific configuration of the impressed mark and a top view (right) of the same mark.
Figure 5:
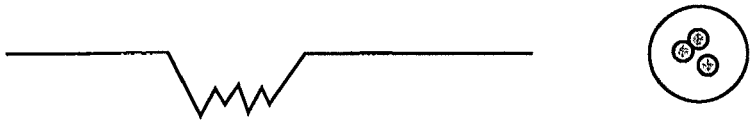
FIG. 5 shows a side view (left) of a further alternative example of a specific configuration of the impressed mark and a top view (right) of the same mark.

In FIGS. 3 through 5, there are shown impressed indentation marks 5, having different three-dimensional configurations.

Figure 3A:
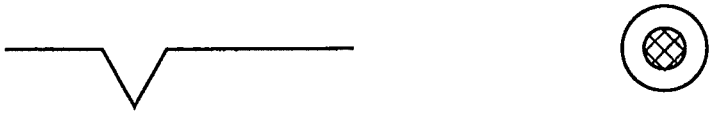
FIG. 3*a* shows a side view (left) of an example of a specific configuration of the impressed mark and a top view (right) of the same mark.

In FIG. 3*a*, a side view (left) and a top view (right) of a typical mark obtained by impressing a round pointed tip into the material web is shown. By the top view, it is illustrated that a dark spot appears from the middle of the impressed mark, where the pointed tip has reached into the material web and the indentation is at its maximum depth. The top view contour of the impressed indentation has the shape of a circular dot. The impressed indentation has the shape of an inverse, hollow cone with a circular or elliptical, open base. In order to obtain a dark shadow from the impressed mark, it is important that the angle at which the surfaces of the impressed indentation incline against each other at a bottom point of the indentation is acute, i.e. smaller than 90 degrees. According to another way of expressing what is required from the indentation, the ratio between the width of the opening contour of the impressed indentation mark at the surface of the web and the maximum depth of the indentation mark should be less than 2.

Figure 3B:
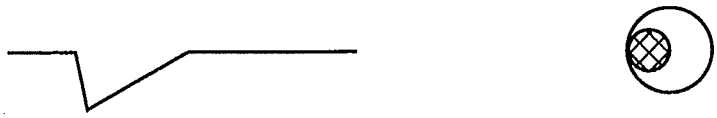
FIG. 3*b* shows a side view (left) of a further example of a specific configuration of the impressed mark and a top view (right) of that same mark.

In FIG. 3*b*, a side view (left) and a top view (right) of a similar mark as in FIG. 3*a* is shown, but with the maximum depth of the impressed indentation mark being placed asymmetrically within the opening contour at the surface of the web.

In FIG. 4*a*, a side view (left) and a top view (right) is shown of a typical mark obtained by impressing a pointed tip having a square or rectangular base, into the material web. By the top view, it is illustrated that a dark spot appears from the middle of the impressed mark, where the pointed tip has reached into the material web and the indentation is at its maximum depth. The top view contour of the impressed indentation has the shape of a quadrant or rectangle. The impressed indentation has the shape of an inverse, hollow pyramid with a square or rectangular, open base. In order to obtain a dark shadow from the impressed mark, it is important that the angle at which the surfaces of the impressed indentation incline against each other at the bottom of the indentation is acute, i.e. smaller than 90 degrees. According to another way of expressing what is required from the indentation, the ratio between the average width of the opening contour of the impressed indentation mark at the surface of the web and the maximum depth of the indentation mark should be less than 2.

In FIG. 4*b*, a side view (left) and a top view (right) of a similar mark as in FIG. 4*a* is shown, but with the maximum depth of the impressed indentation mark being placed asymmetrically within the opening contour at the surface of the web.

In FIG. 5, a side view (left) and a top view (right) of a further variation of a mark obtained by impressing a structure of several pointed tips into the material web is shown. By the top view, it is illustrated that a dark spot appears from the areas of the impressed mark, where the pointed tips has reached into the material web and the indentation is deep. The top view contour of the impressed indentation has the shape of a circular dot having smaller dark spots in the centre. In order to obtain a dark shadow from the impressed mark, it seems important that the angle at which the surfaces of the impressed indentation incline against each other at the bottom of the indentations from the pointed tips is acute, i.e. smaller than 90 degrees. According to another way of expressing what is required from the indentations, the ratio between the width of the opening contour of the impressed indentation mark at the surface of the web and the maximum depth of the indentation mark should be less than 2.

Figure 6A:
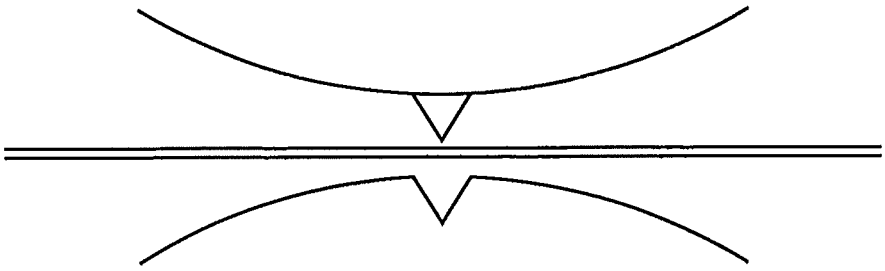
FIG. 6*a* is a side view showing an example of an impressing tool for the impressed mark as illustrated in FIGS. 3*a* and *b*.

FIG. 6*a* is a side view of an example of an impressing means for an impressed mark as illustrated in FIG. 3*a*, i.e. a protruding pointed tip having a circular base, attached to a male part of an impressing means, such as a roller, suitably a creasing roller. The other part of the impressing means, acting on the other side of the material web, may be a female part, suitably a female roller, having a corresponding recess opposite to where the protrusion impresses the material web.

Figure 6B:
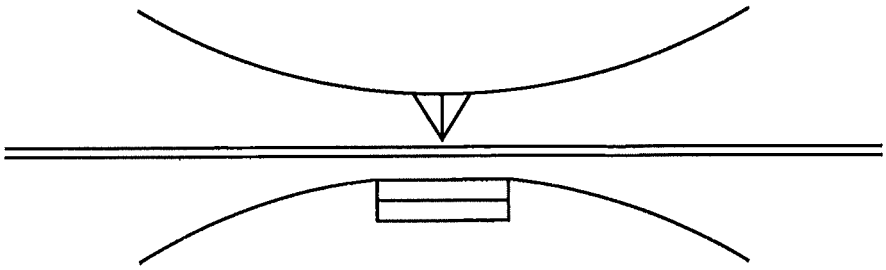
FIG. 6*b* is a side view showing an other example of an impressing tool, as intended for the impressed mark as illustrated in FIGS. 4*a* and *b*.
Figure 7:
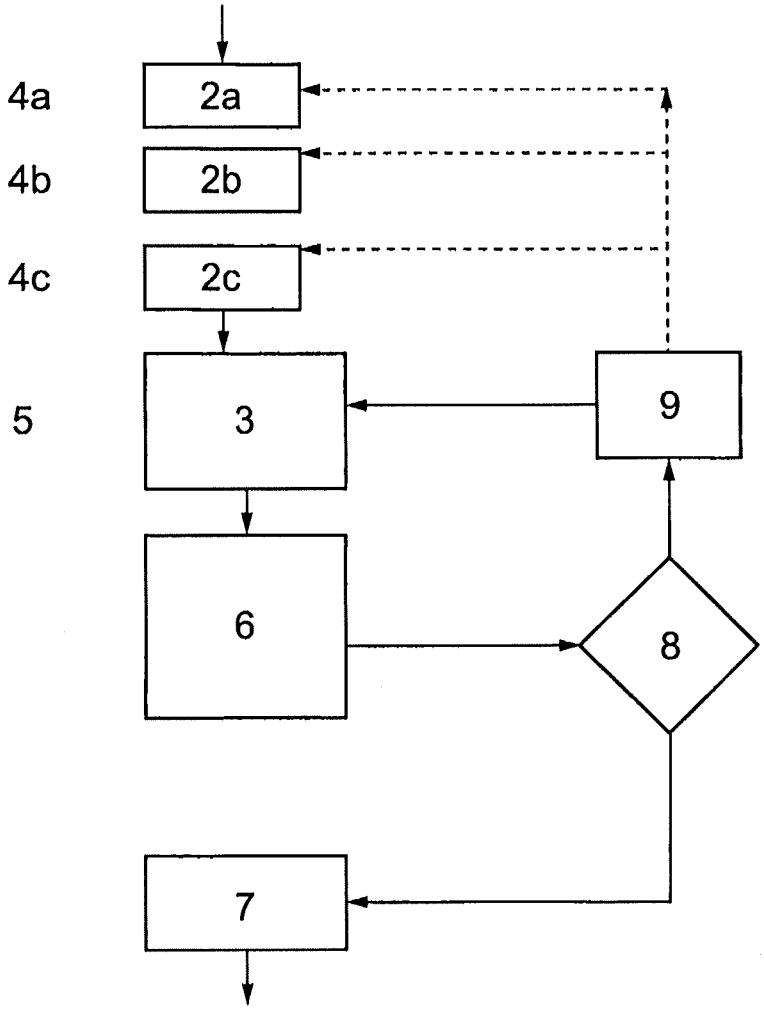
FIG. 7 is a flow chart showing a preferred embodiment of the method of manufacturing a packaging material according to the invention.

FIG. 6*b* is a side view showing a further example of an impressing means intended for an impressed mark as illustrated in FIG. 4*a*, i.e. a protruding pointed tip having a square or rectangular base, attached to a male part of an impressing means, such as a roller, suitably a creasing roller. The other part of the impressing means, acting on the other side of the material web, may comprise a rubber block or dolly, being positioned opposite to where the protrusion impresses the material web FIG. 7 is a flow-chart showing the main steps of a preferred embodiment of the method according to the invention.

The material web is preferably first passing one or more printing units 2*a*, 2*b*, 2*c*, depending on how many colours will be used in the printed pattern, wherein one printed register mark 4*a*, 4*b*, 4*c* will be provided by each respective printing press. In the next step 3, a non-printed pattern will be created on the web, preferably a pattern of creasing lines. Simultaneously, with the creation of the non-printed pattern, preferably the creasing operation 3, an impressed indentation mark 5 is created.

An optical sensor 6 is detecting the positions of the printed register marks 4 and 5 and the measured values are registered by a computer 8, comparing the measured values with a pre-set value programmed in the computer. If the measured values deviate from the pre-set values, feedback signals are conveyed to regulating means 9 for adjusting the printing 2 and/or the non-printing 3, preferably creasing, operations. Optionally, further operations 7, such as for example further hole cutting operations or perforation cutting operations, may be controlled by the detected positions of the printed marks 4, aligned with the impressed indentation mark 5.

Figure 8A:
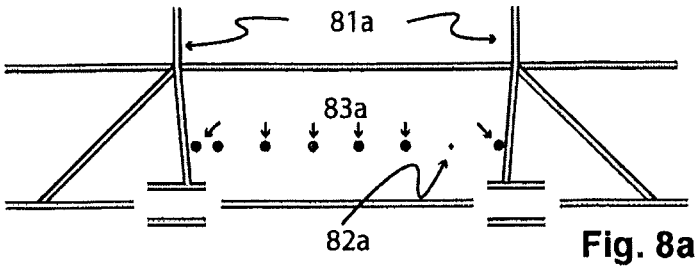
FIGS. 8*a*, 8*b*, 8*c* and 8*d* show alternative embodiments of impressed marks, for possible use according to the invention.

FIG. 8*a* shows the regular embodiment providing one impressed indentation mark, thus creating one shadow mark, as described in the above.

Figure 8B:
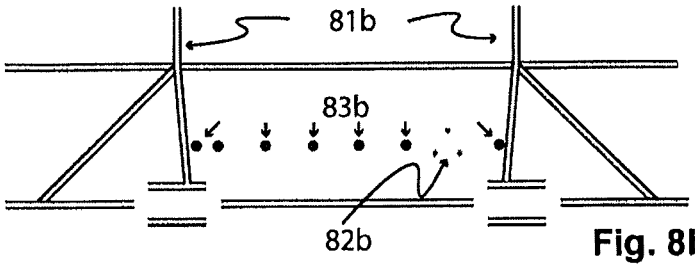
Figure 8C:
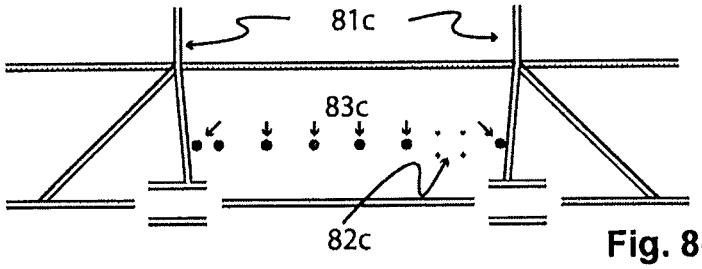
Figure 8D:
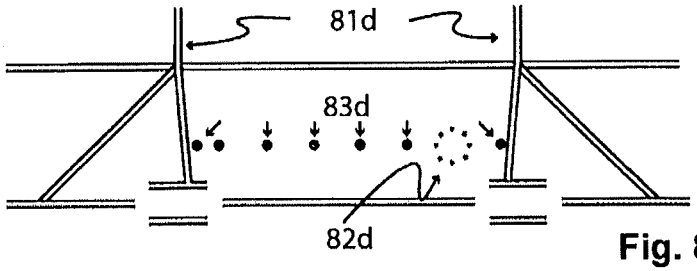

FIGS. 8*b*, 8*c* and 8*d* show alternative embodiments, each providing a set of multiple smaller marks, which form a mark pattern, thus creating multiple shadow marks. Thus, the impressed indentation may alternatively include multiple shadow marks, which form a pre-determined pattern. Such marks of multiple indentations that create multiple shadow marks when illuminated, are thus also conceivable within the scope of the claimed invention. By measuring a group of such distinct marks, which together form a certain pre-determined pattern, it may be possible to further increase the accuracy of the measurements and to control the printing and non-printing operations with respect to each other even better with even higher accuracy.

Still further embodiments, different or modified from the above described Figures and Examples of this application, are conceivable within the scope of the appended claims.

The invention claimed is:

1. Method of controlling the register, between a printed pattern and a non-printed pattern, with high accuracy, on a running material web, comprising:

a) printing at least one printed pattern and at least one, printed, two-dimensional, register mark on the web, b) creating a non-printed pattern or recurring feature on the web, steps a) and b) being carried out in any order, c) simultaneously, and in synchronisation with the operation of carrying out step b), impressing an indentation having a three-dimensional topographic configuration such that a shadow is created from the indentation when illuminated, on the web at a pre-determined distance from the printed register mark, the indentation thereby producing a dark spot when illuminated, d) determining the position of the said shadow or dark spot relative to the position of the printed mark by illuminating and detecting with an optical sensor system, the shadow being detectable by the same optical sensor system as used for detecting the printed mark, e) comparing the value of the measured position of the shadow created from the impressed indentation relative to the position of the printed mark with a pre-set value, and f) regulating the operation of creating said non-printed pattern or recurring feature as well as said synchronised, impressed indentation and/or regulating the printing operation, in order to adjust the measured value to the pre-set value.

2. The method of claim 1, wherein the printing operation is carried out before the non-printing operation.

3. The method of claim 1, wherein step a) is carried out before step b) and concerns providing a pre-printed material web having at least one printed pattern and at least one, printed, two-dimensional, register mark on the web.

4. The method of claim 1, wherein step b) is carried out before step a) and concerns providing a pre-made material web, having at least one non-printed pattern or recurring feature and at least one, impressed indentation mark with a three-dimensional topographic configuration, such that a shadow is created from the indentation when illuminated, on the web at a pre-determined distance from the printed register mark, the indentation thereby producing a dark spot when illuminated.

5. The method of claim 1, wherein the position of the said shadow relative to the position of the printed mark is determined both in the machine direction (MD) and in the transversal direction (TD).

6. The method of claim 1, wherein the printed pattern comprises several consecutively printed colours and each printed colour pattern has a printed register mark, each respective consecutive printed mark being controlled to be in register with the first printed mark, by means of the same optical sensor system.

7. The method of claim 1, wherein the size and the shape of the top view contour of the said shadow is given approximately the same size and shape as of the printed mark.

8. The method of claim 1, wherein the top view contour of the said shadow, as well as the printed mark, are given the shape of a circular dot.

9. The method of claim 1, wherein the non-printed pattern is a pattern of creased or scored folding lines.

10. The method of claim 1, wherein the non-printed pattern comprises repetitive, punched or cut perforation lines or holes.

11. The method of claim 1, wherein the non-printed pattern is an embossed pattern or relief pattern.

12. The method of claim 1, wherein the step f) of regulating the operation of creating the non-printed pattern and/or the printing operation comprises regulating the web position in the transversal direction.

13. The method of claim 1, wherein the step f) of regulating the operation of creating the non-printed pattern and/or the printing operation comprises regulating the rotational speed of one or more of the printing rollers and/or the feeding rollers of the operation wherein the non-printed pattern is created, preferably creasing rollers.

14. The method of claim 1, wherein the impressed indentation is formed by pressing a pointed tip into the material web at a pre-determined depth.

15. The method of claim 1, wherein the impressed indentation has an opening contour with a width W at the surface of the web material and a maximum depth d at a bottom point within the area of the opening contour, such that the surfaces of the indentation are inclining towards each other, at a bottom point, at an acute angle.

16. The method of claim 1, wherein the impressed indentation has the shape of an inverse, hollow cone with a circular or elliptical, open, base.

17. The method of claim 1, wherein the impressed indentation has the shape of an inverse, hollow pyramid with a base of square, rectangular or rhomboid shape.

18. A method of manufacturing a material, comprising the method of controlling the register, on a running web of the material, between a printed pattern and a non-printed pattern on the web, as claimed in claim 1.

19. A method of manufacturing a packaging material, comprising the method of controlling the register, on a running material web, between a printed pattern and a pattern of creased folding lines or holes, as claimed in claim 1.

20. A system used in a method of manufacturing a material web having a printed pattern in register position with a non-printed pattern or recurring feature on the material web, comprising:

g) a station for providing a printed material web, wherein at least one pattern is printed together with at least one, printed, two-dimensional register mark on the web, h) a station for creating a non-printed pattern or recurring feature on the web, and, impressing means for simultaneously, and in synchronisation with the creation of the non-printed pattern or feature, creating an indentation having a three-dimensional topographic configuration, such that a shadow is created from the indentation when illuminated, on the web at a pre-determined distance from the printed register mark, i) an optical sensor system for determining the position of the said shadow relative to the position of the printed mark by detecting the shadow produced by said three-dimensional indented configuration when illuminated, and by simultaneously detecting the printed mark(s), j) a comparison means for comparing the value of the measured position of the shadow relative to the position of the printed mark with a pre-set value, and k) controlling means for regulating the operation of creating said non-printed pattern or recurring feature as well as said synchronised, impressed indentation and/or for regulating the printing operation, in order to adjust the measured value to the pre-set value.

21. The system of claim 20, wherein the station g) precedes the station h) and further comprises an unwinding station, the printed pattern and the printed register mark having been pre-printed onto the web in a separate preceding operation.

22. The system of claim 20, wherein the station h) precedes the station g) and comprises an unwinding station, the non-printed pattern or recurring feature together with the impressed indentation mark having been pre-created onto the web in a separate operation.

23. The system of claim 20, wherein the station for creating a non-printed pattern or recurring feature on the web is a creasing station.

24. The system of claim 20, wherein the station for creating a non-printed pattern or recurring feature on the web is a perforation-cutting or hole-punching station.

25. The system of claim 20, wherein the station for creating a non-printed pattern or recurring feature on the web is a perforation or hole cutting station.

26. The system of claim 20, wherein the station for creating a non-printed pattern or recurring feature on the web is an embossing station.

27. The system of claim 20, wherein the sensor control system comprises a matrix sensor, integrated with an illumination source and adapted for detecting pre-defined register marks.

28. The system of claim 20, wherein said comparison means includes a computer, which is connected to the optical sensor for registration of the measured relative positions and to the controlling means for regulating the operation of the printing press and/or the non-printing operation.

29. The system of claim 20, wherein the means for impressing said indentation comprises a pointed tip, arranged to be pressed into the material web at a pre-determined depth.

* * * * *